US006315318B1

(12) United States Patent
Caron et al.

(10) Patent No.: US 6,315,318 B1
(45) Date of Patent: Nov. 13, 2001

(54) BOOT BINDING SYSTEM

(75) Inventors: Jeffrey E. Caron, Tiverton; Geoffrey W. Smith, Portsmouth, both of RI (US)

(73) Assignee: Caron Alpine Technologies, Inc., Tiverton, RI (US)

( * ) Notice: Subject to any disclaimer, the term of this patent is extended or adjusted under 35 U.S.C. 154(b) by 0 days.

(21) Appl. No.: 09/232,189

(22) Filed: Jan. 14, 1999

Related U.S. Application Data

(60) Provisional application No. 60/071,340, filed on Jan. 14, 1998.

(51) Int. Cl.[7] ..... A63C 9/00
(52) U.S. Cl. ..... 280/617; 280/607
(58) Field of Search ..... 280/617, 618, 280/623, 626, 634, 636, 611, 14.2

(56) References Cited

U.S. PATENT DOCUMENTS

| | | | | |
|---|---|---|---|---|
| 3,790,186 | * | 2/1974 | Kanno | 280/617 |
| 4,022,491 | * | 5/1977 | Powell | 280/617 |
| 4,067,593 | | 1/1978 | Earl | 280/617 |
| 4,141,570 | * | 2/1979 | Sudmeier | 280/617 |
| 5,044,654 | | 9/1991 | Meyer . | |
| 5,344,179 | | 9/1994 | Fritschi . | |
| 5,480,175 | * | 1/1996 | Astier et al. | 280/617 |
| 5,730,457 | * | 3/1998 | Couderc et al. | 280/617 |
| 5,741,023 | * | 4/1998 | Schiele et al. | 280/617 |

FOREIGN PATENT DOCUMENTS

| | | |
|---|---|---|
| 678278 | 12/1978 | (CH) . |
| WO94/25125 | 11/1994 | (WO) . |
| WO95/20423 | 8/1995 | (WO) . |

OTHER PUBLICATIONS

Fritschie Catalog; Model '95 Diamond Teeny.

* cited by examiner

*Primary Examiner*—Brian L. Johnson
*Assistant Examiner*—G B Klebe
(74) *Attorney, Agent, or Firm*—Samuels, Gauthier & Stevens

(57) ABSTRACT

A boot binding system is shown for use especially on skiboards, having a binding plate, boot supports, bails, a lever, a resilient material, and a size adjustment locking mechanism. Boot supports and binding plate are complimentary shaped for slideable affixation to each, without requiring additional fasteners. A simple fastener locks the relative position of the boot support on the binding plate while also immobilizing any boot support motion. In the locked position, the fastener mates with counterbores in the binding plate's surface. The binding plate is rectangular in top view and its longitudinal edges have a chamfer, which complements a chamfer on the boot supports. The binding plate has mounting holes in its central region, which are used to affix the binding to a skiboard. Resilient material exists between the binding plate and the skiboard, thereby allowing the skiboard to flex more freely. The boot supports have slots to retain the bails. The lever also has a slot to accept a bail. The binding is simple to manufacture and assemble making it cost competitive for production. An alternate embodiment includes a version that eliminates the need for resilient material. A second alternate embodiment eliminates the central mount and mounts to the skiboard in the region of the boot supports.

23 Claims, 9 Drawing Sheets

BOOT BINDING SYSTEM

BACKGROUND—CROSS-REFERENCES TO RELATED APPLICATIONS

This application claims the benefit of US provisional patent application 60/071,340, filed Jan. 14, 1998.

BACKGROUND—Field of the Invention

This invention relates to snow sport bindings, and is specifically an improved non-safety release binding, which affixes a boot to a skiboard, snowboard, ski, or snow sports equipment.

BACKGROUND—Discussion of Prior Art

Early ski bindings provided various mechanisms to affix and detach a boot to a ski. Such bindings would require the user to willfully attach and detach the boot from the ski before and after use and did not employ any type of safety release mechanism. Numerous injuries to skiers' legs forced the development of safety release ski bindings. Many of these injuries are attributable to the long length of the ski. Modern safety release ski bindings employ sophisticated mechanisms to ensure proper safety release of the skiers' boot and minimize the likelihood of injury.

The development of the snowboard has evidenced a different scenario in that the reduction of bodily injuries has not been correlated with safety release binding features. Hence, snowboard bindings are similar to early ski bindings in that they attach and detach the boot from the snowboard only when the user desires. Snowboard bindings do not employ a safety release mechanism to release the snowboarders boot while in use.

A skiboard is a type of snow ski, which is short, looks like a snowboard, and provides a sensation similar to that of inline skates. Skiboards tend to be less than 1.1 meters in length, and therefore do not present the same potential for injury, as do traditional longer skis. Consequently there is no substantial evidence for the case of employing safety release bindings on skiboards. Like snowboard bindings, skiboard bindings attach and detach the boot from the skiboard only when the user desires and do not employ a safety release mechanism to release the snowboarders boot while in use.

Snowboarders use either 'hard-boots' or 'soft-boots' depending on their preference while the majority of skiboarders use 'hard-boots'. 'Hard-boots' include modem plastic shell ski boots and versions of them slightly modified for skiboard and snowboard specific use. This invention is a binding designed to affix 'hard—boots' to a skiboard, snowboard, or other snow sports equipment.

Much of the relevant prior art exists in the field of 'plate' snowboard bindings and skiboard bindings. Plate snowboard bindings and skiboard bindings attach hard shell boots to the snowboard or skiboard. Traditionally hard shell boots have a means to engage the binding at the boot's toe and heel. This usually is in the form of two lips, each existing at the boot's extent. The relative position of the two lips varies with the boot size. Hence the binding must be easily adjustable to engage various boot sizes. Another desirable feature of plate snowboard bindings is their ability to provide a rigid interface between the boot and skiboard or snowboard. A rigid interface provides the user with increased performance. Durability is a third desirable feature, which provides the user with reliable equipment. Skiboard binding and snowboard plate binding manufacturers have succeeded to varying degrees in terms of their implementation the above desirable qualities, namely ease of adjustment, rigidity, and durability.

The most popular mechanism used for binding size adjustment is a lead screw. Generally rotating the lead screw changes the position of a boot support relative to a binding plate. A bail is connected to the boot support and hence rotating the lead screw performs size adjustment. This is evidenced in the prior art and is widely employed in the industry. A disadvantage to an adjustment means comprising a lead screw is that the boot support must be affixed to the binding plate in a manner such that it can slide when the lead screw is turned. Hence, the boot support-binding plate connection must have dimensions and tolerances that prevent excessive friction. Such a connection inevitably prevents rigid holding of the boot support, allowing the boot support to move when in use. These movements, especially in the lateral direction, detract from the bindings overall performance because the bindings rigidity is reduced.

Another widely used adjustment means affixes the boot support and attached bail to the binding plate by a clamping means. The clamping means often comprises fastener(s), which are threaded into the binding plate, and when tightened, hold the boot support firmly against the binding plate. This type of clamping means must prevent all movement between the boot support and binding plate.

There are numerous examples of bindings that use such a clamping means. Many use two screws to affix the boot support to the binding plate, and this has numerous disadvantages. First, size adjustment requires removal of the screws, which lends itself to loss of the fastener. Second, two screws are required to properly prevent the boot support from movement, adding to user complexity and cost. Additionally, to accommodate the size range, the binding plate has many costly threaded holes, each of which contributes to the manufacturing cost. Lastly, the size adjustment increment is limited by the required spacing of the tapped holes.

A first skiboard binding once produced by Caron Alpine Technologies, Inc. is similar to the above binding in that it uses two fasteners and threaded holes, but additionally has mating teeth on the binding plate and boot support. While the teeth enable the quantity of threaded holes to be reduced and also simplify adjustment, this binding still shares most of the above disadvantages.

A second skiboard binding produced by Caron Alpine Technologies, Inc. has far fewer disadvantages. It replaces the threaded holes by a single fastener, nut, and slot arrangement in combination with mating teeth on the binding plate and boot support. This implementation overcomes all the aforementioned disadvantages. However, a disadvantage of this binding is the cost increase to add the mating teeth to the binding plate and boot support, although this cost does not make the total binding cost unreasonable.

As a variation to the aforementioned binding, another binding is similar in that the boot support is attached to the binding plate by a single fastener, nut, and slot arrangement. However, the primary difference is that the mating teeth of the aforementioned binding are replaced by two series of locating holes in the binding plate and two locating pins in the boot support. The cost of this implementation is a disadvantage due to the multiplicity of locating holes and the expense associated with the locating pins.

Additional prior art reveals a snowboard binding having boot supports slideably attached to a plate structure for size adjustment. The boot support is locked into a position along the plate by a part which functions like locating pin. The part is shaped such that the user can readily remove and insert the part without the use of tools. This provides the user with a simple adjustment means. This implementation has the same disadvantage evidenced in most lead screw based bindings, specifically that the part dimensions and tolerances needed for the binding plate and boot support to be slideable prevent rigid holding of the boot support. This allows the boot support to move when in use and thereby decreasing the bindings performance.

A final binding design affixes the boot support to the binding plate by two fasteners. The binding plate has teeth, which mate with a toothed lever cam attached to the boot support. To adjust the position of the boot support, one disengages the lever cam, slides the boot support to the desired position, and finally re-engages the lever cam. When the lever cam is disengaged, the boot support and fasteners are free to slide along slots in the binding plate. When the lever cam is engaged, the boot support and fasteners are not free to slide along the slots in the binding plate. A disadvantage to this implementation is the product's complexity and associated cost. Specifically, two fasteners are required per boot support, thereby requiring two slots in the binding plate, which all contribute to the manufacturing cost. Additionally, the lever cam and mating teeth in the binding plate contribute to the cost. Due to the complexity of the lever cam, plastic is the most likely candidate material for this part. This introduces concerns about part wear and durability.

Objects and Advantages

Accordingly, several objects and advantages of this invention are ease of use, low cost to manufacture, high performance, reliability and durability. Ease of use is derived by a central mount capability of the binding that affords the user simple installation and removal of the binding from the skiboard. Additionally, the central mount ensures the binding is compatible with a variety of skiboard brands. A single fastener adjustment allows for efficient adjustment to accommodate various boot sizes. In this disclosure adjustment fastener and size adjustment screw 501 are meant to be equivalent and interchangeable. The size adjustment process does not require removal of the fastener. A lever is used in conjunction with bails, which efficiently allows the user to affix or detach a boot.

The binding is cost effective to manufacture, thereby making it marketable. A boot support is attached to a binding plate by use of interlocking shapes, thereby eliminating the need for fasteners to perform this function. In this disclosure the terms boot support or bail block, and binding plate or platform are used interchangeably. Only a single fastener pair is required to lock the boot support in a size position, and this fastener pair is available as a standard off the shelf hardware item. The binding plate has only a single row of non-threaded counterbores with which the adjustment fastener engages. Counterbores are less costly to produce than threaded holes. Both the binding plate and boot support can be efficiently manufactured by a combination of aluminum extrusion and machining. Aluminum extrusion is in itself a very cost effective process, and the necessary machining to each part can be performed by a single load into a machining center, thereby further reducing cost. The combination of extrusion and machining can enhance cash flow associated with manufacturing by making small production runs with a short lead-time feasible. The means by which the boot size adjustment is implemented relaxes constraints on manufacturing tolerances. Bails are attached to boot supports by simple machined slots, which are efficient for assembly purposes. Overall, the bindings simplicity make it easy to assemble, which also contributes to cost effectiveness.

The binding's design lends itself well to be manufactured for high performance. A binding plate and boot supports manufactured from aluminum allow for superior structural properties, thereby offering the user increased rigidity, resulting in increased performance. A secondary benefit of a rigid binding plate is its ability to be centrally mounted to the skiboard, which has additional performance advantages. The boot size adjustment means solves the problem of the boot support having undesirable movement relative to the binding plate, especially lateral movement. The spacing of the counterbores used for size adjustment permits a relatively fine boot size adjustment, which provides the user with an improved connection to the skiboard.

The binding's inherent design makes it suitable for manufacture from materials that exhibit superior structural properties. Such materials tend to be reliable, durable, and resistant to wear.

Other objects and advantages are related to the flexing of the skiboard. When the skiboard flexes due to turning and terrain, the resilient material compresses, thereby allowing the skiboard to flex more freely than if the binding plate were mounted directly to the skiboard. Furthermore, because the binding plate is substantially rigid, its central mount allows for less restricted flex of the skiboard. The resilient material also dampens some of the unwanted vibrations that would otherwise be transmitted through the binding to the user. Additionally, an alternate binding plate with tapered ends allows the skiboard to flex freely without the use of a resilient material. This has the potential advantage of reduced cost, assuming that production volumes are sufficiently large to justify manufacture of the binding plate.

Additional objects and advantages include a unique friction supported heel bail, a cost effective lever and toe bail assembly, a mounting capability that allows the binding to be compatible with skiboards that are designed for ski screw mounting. The boot size adjustment means could also be utilized on snowboard bindings.

Further objects and advantages of my invention will become apparent from a consideration of the drawings and ensuing description.

DESCRIPTION OF PREFERRED EMBODIMENT

Overview

Figure 1:
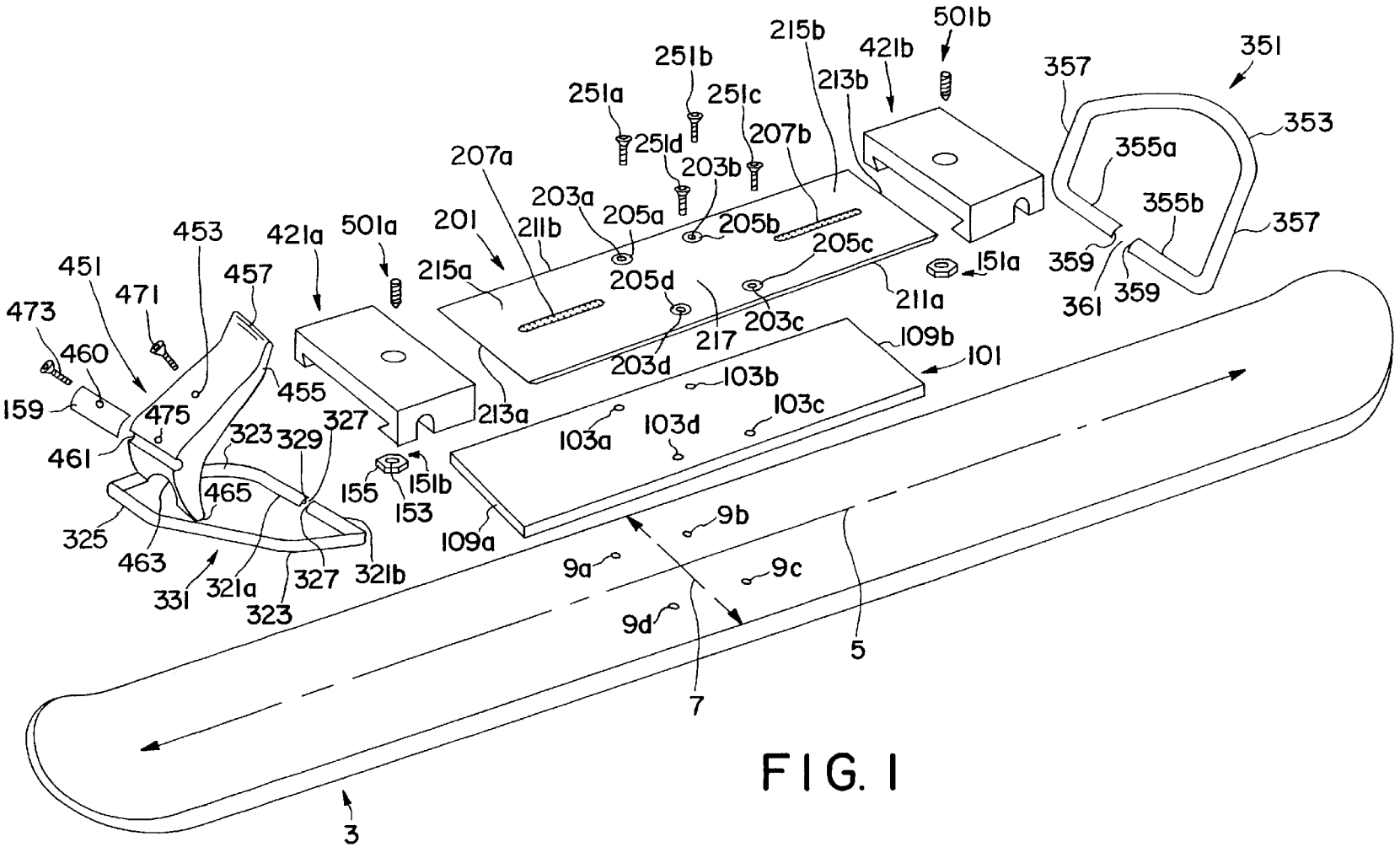
FIG. 1 shows a first embodiment exploded view of a binding and a skiboard.

Embodiments for a binding which retains a boot 601 to a skiboard 3 are given. A first binding embodiment retains a boot 601 to a skiboard 3. A skiboard 3 is generally a short version of a traditional ski, for use on snow, and usually under 110 cm in length. A typical length for a skiboard is 80–100 cm. The length limitation results from the fact that the binding types used on skiboards are generally not safety release bindings, meaning they do not release during use to reduce the risk of injury. A skiboard 3 is highly maneuverable, lightweight, and provides the user with a sensation analogous to that experienced from in-line skates and skiing. Some modem skiboards have a symmetrical twin tipped design. Skiboarding is a new sport. Recently the number of manufacturers of skiboards has dramatically increased. It should be noted that the binding of this invention can easily be modified for use on a snowboard.

In some cases a skiboard has skiboard mounting holes 9 *a,b,c,d* which facilitate affixation of a binding to it by use of a machine screw. In other cases a skiboard is custom drilled to accept binding fasteners. Such fasteners are similar to self-tapping ski screws. Similarly a boot 601 generally has a boot sole 615 which facilitates it's affixation to a binding.

This invention is not limited to the embodiments given in this disclosure. Thus the scope of the invention should be determined by the claims and their legal equivalents, rather than by the examples given.

DETAILED DESCRIPTION

General

FIG. 1 shows a skiboard 3 comprising four skiboard mounting holes 9*a*, 9*b*, 9*c*, 9*d*. Skiboard mounting holes 9*a*, 9*b*, 9*c*, 9*d* often contain 6 mm diameter×1 mm pitch stainless steel threaded inserts of the type commonly used in the snowboard industry. Additional sizes of inserts and fasteners can be utilized. While four skiboard mounting holes 9*a*, 9*b*, 9*c*, 9*d* are depicted in FIG. 1 and are the preferred number, fewer or more mounting holes will suffice.

Figure 11:
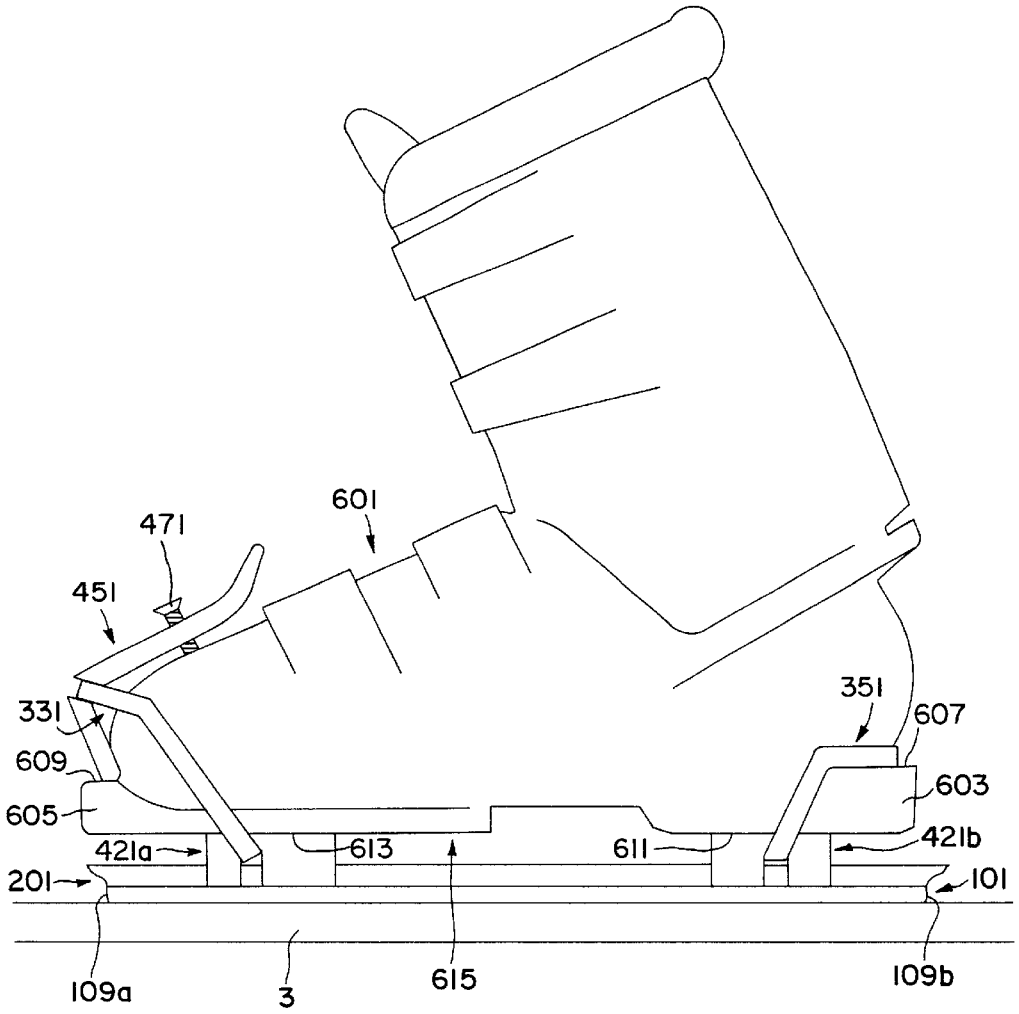
FIG. 11 shows a side view of a boot engaged in the binding.

As shown in FIG. 1 a platform 201 mounts to skiboard 3. A resilient material 101 is between to skiboard 3 and platform 201. A bail block 421*b* is joined to platform 201 in platform region 215*b* and holds secure rotary heel bail 351 which in turn holds secure a boot heel lip 607, as shown in FIG. 11. Similarly, a bail block 421*a* is joined to platform 201 in platform adjustment region 215*a* and holds secure a toe bail 331, as shown in FIG. 11. A lever 451 is also attached to toe bail 331 and is used to secure boot toe lip 609.

A lever 451 is used to clamp boot toe lip 609 and a heel bail, specifically referred to as a rotary heel bail 351, is used to clamp boot heel lip 607. It should be noted that with slight modifications lever 451 could be used to clamp boot heel lip 607. Similarly, with slight modification rotary heel bail 351 could be used to clamp boot toe lip 609.

Resilient Material

As shown in FIGS. 1 and 11 a resilient material 101 rests between skiboard 3 and platform 201. Resilient material 101 comprises resilient material screw holes 103*a*, 103*b*, 103*c*, 103*d* positioned to match the position of skiboard mounting holes 9*a*, 9*b*, 9*c*, 9*d*. Resilient material is sized to the approximate diameter of platform 201. The extent or length of resilient material 101 is determined by the position of a resilient material end 109*a* and a resilient material end 109*b*. FIG. 11 clearly depicts resilient material ends 109*a,b* extending approximately to the platform ends 213*a,b*. While the extent of resilient material ends 109*a,b* can vary, in the preferred embodiment they extend from one third to full length of platform 201. Resilient material 101 exhibits the properties of an elastomer with a durometer in the range from 50 to 90. However, the composition of resilient material 101 is not limited to elastomers. In the preferred embodiment, resilient material 101 has thickness ranging from 3 millimeters to 12 millimeters. The amount of resilience could vary with the position under platform 201, thereby allowing for varying compressibility in different locations. Resilient material 101 is not limited to the perimeter shape as set forth in FIG. 1, and could take on a different shape dependent upon the desired compression properties along its length.

Platform

Figure 2:
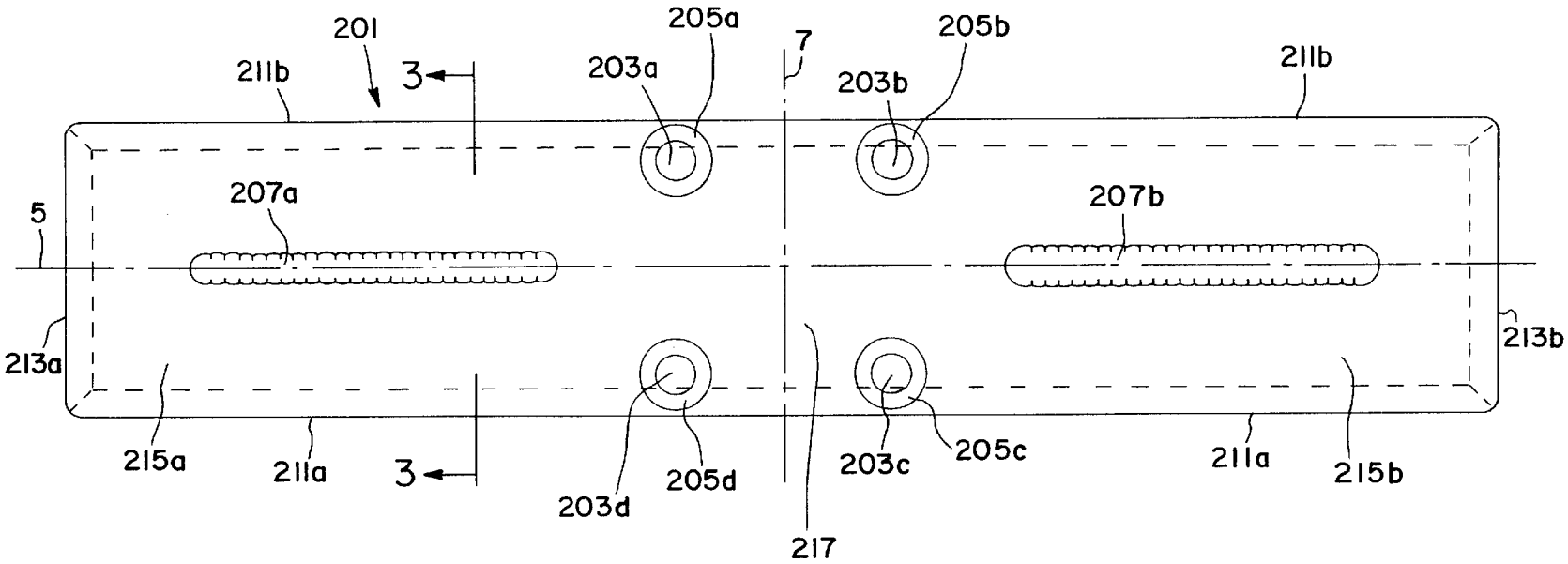
FIG. 2 shows a top view of a first embodiment platform.
Figure 10:
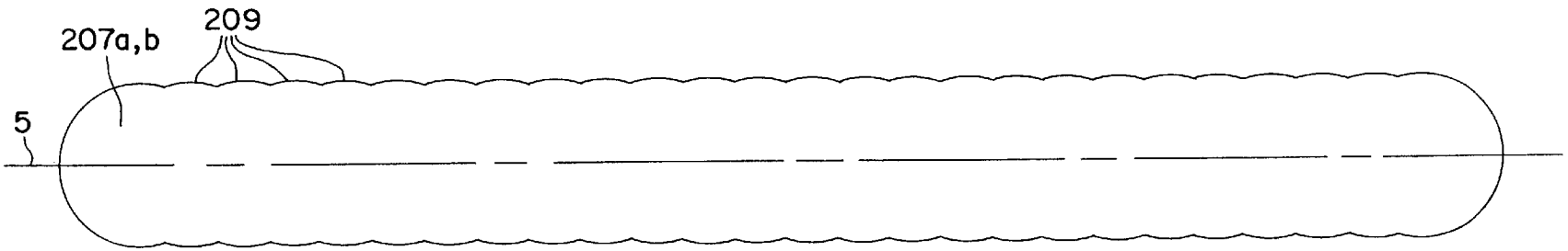
FIG. 10 shows a platform top surface view of size adjustment countersinks.

FIG. 2 shows a platform 201 having two platform ends 213*a,b* and a platform central region 217 therebetween. A skiboard longitudinal axis 5 coincides with the platform's longitudinal axis when platform 201 is mounted to skiboard 3. Similarly a skiboard transverse axis 7, perpendicular to skiboard longitudinal axis 5 and in the same plane as the skiboard, coincides with the platform's transverse axis when platform 201 is mounted to skiboard 3. As shown in FIGS. 1 and 2 a platform size adjustment region 215*a,b* is located near each platform end 213*a,b*. Platform 201 has a platform top surface 219 and a platform bottom surface 221. Platform top surface 219 has platform size adjustment countersink 207*a,b*. FIG. 10 shows a platform size adjustment countersink edge 209*a,b* at its intersection with platform top surface 219. The drill centers in forming adjustment countersink 207*a,b* are usually in the range of 1 to 4 mm apart. Optimally the spacing of the drill centers is in the range of 1.5 mm to 3 mm. The spacing of the centers is less than the diameter of the drill tool, and hence the material removal areas overlap.

As shown in FIGS. 1 and 2 platform 201 has four-platform screw holes 203*a*, 203*b*, 203*c*, 203*d* located in platform central region 217. Each platform screw hole is positioned to align with resilient material screw holes 103*a*, 103*b*, 103*c*, 103*d* and skiboard mounting holes 9*a*, 9*b*, 9*c*, 9*d*. Each platform screw hole 203*a*, 203*b*, 203*c*, 203*d* has a respective platform screw hole counter bore 205*a*, 205*b*, 205*c*, 205*d*.

Platform screw holes 203*a*, 203*b*, 203*c*, 203*d* are located in platform central region 217. Four platform screw holes 203*a*, 203*b*, 203*c*, 203*d* centrally located in platform 201 offer a high performance, durable, and cost effective means to secure platform 201 to skiboard 3. In the preferred embodiment, platform screw holes 203*a*, 203*b*, 203*c*, 203*d* are located at the comers of a rectangle ranging in dimensions from 40 mm×40 mm to 120 mm×60 mm.

In the preferred embodiment platform 201 is constructed from 7075-T6 aluminum. This material offers sufficient strength at an acceptable weight and is readily available. In the preferred embodiment the overall dimensions of aluminum platform 201 range from 180 mm long×45 mm wide× 6.3 mm thick to 280 mm long×80 mm wide×12.7 mm thick. Optimum platform dimensions for aluminum construction are approximately 260 mm long×55 mm wide×7 mm thick. This size accommodates most boot sizes, provides adequate stiffness in its longitudinal direction, and is lightweight. Other aluminum alloys may be used to fabricate platform 201. The dimensions of platform 201 are determined in part by the alloy used so that design criterion is met. Processes to shape platform 201 from aluminum include but are not limited to machining, extrusion, molding, casting, or a combination thereof.

Alternatively platform 201 may be fabricated from other materials such as thermoplastics, reinforced thermoplastics, carbon fiber, Kevlar, and titanium. If these materials are used the optimum dimensions of platform 201 will vary from those of aluminum.

Platform size adjustment countersinks 207*a,b* are located in platform adjustment region 215*a,b* respectively of platform 201. The extent of platform adjustment region 215*a,b* is determined by the range of boot sizes that must be accommodated. The optimum length of platform adjustment region 215*a,b* has been determined to be from 35 mm to 65 mm long. The depth and angle of platform size adjustment countersink 207*a,b* is determined by the dimensions of a size adjustment screw 501*a* and 501*b*.

Figure 3:
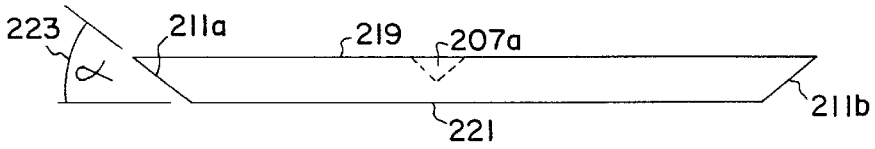
FIG. 3 shows a cross section end view along line B—B from FIG. 2 of a first embodiment platform.
Figure 5:
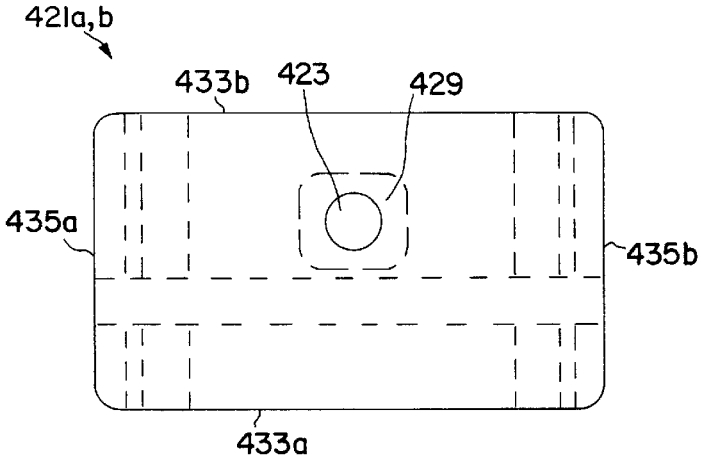
FIG. 5 shows top view of a bail block.

A platform angled edge 211*a,b* extends along platform 201 approximately parallel to it's longitudinal axis, also approximately parallel to skiboard longitudinal axis 5 when platform 201 is mounted to skiboard 3. Platform angled edge 211*a,b* is shown in FIG. 3. FIG. 3 shows a platform edge angle 223 (alpha). Platform angled edge 211*a,b* is measured between platform bottom surface 221 and platform angled edge 211*a,b*. A general range for platform edge angle 223 is between 30 and 60 degrees. The actual shape detail of platform angled edge 211*a,b* is not limited to a linear chamfer, but can also include a curve or a combination of curves. By using a variety of shapes the necessary function can be achieved.

Toe Bail, Lever, and Lever Screw—Assembly

As shown in FIGS. 1 and 11 toe bail 331 has a toe bail first axle section 321*a,b* connected to a toe bail radius section 323. Toe bail radius section 323 joins a toe bail second axle section 325. A toe bail gap 327 separates two toe bail ends 329. Alternatively, toe bail gap 327 can be eliminated if toe bail ends 329 are welded. Possible materials to manufacture toe bail 331 include stainless steel, spring hardened stainless steel, titanium, and steel. The material of preference is stainless steel. If stainless steel is used in a non-hardened form, an optimum wire diameter range is approximately 5 mm to 8 mm. Such bails are considered wireforms and are usually made in four-slide machines.

As shown in FIGS. 1 and 11 a lever 451 has a lever bail slot 461. Toe bail second axle section 325 coexists after assembly in lever bail slot 461. One end of lever 451 has a lever scallop 463 finished with a lever second rounded end 465. The opposite end has a lever finger tab 455 finished with a lever first rounded end 457. A lever adjustment screw hole 453 is located between lever finger tab 455 and lever bail slot 461. To assemble toe bail 331 to lever 451, one places toe bail second axle section 325 into lever bail slot 461. A lever tab cover 459, having a lever tab cover hole 460, is positioned over toe bail second axle section 325 and lever bail slot 461. Lever 451 has a lever tab hole 475 and a lever cover screw 473 is used to affix lever tab cover 459 to lever 451. Materials to manufacture lever 451 include, but are not limited to, aluminum, thermoplastics, reinforced thermoplastics, carbon fiber, Kevlar, and titanium. The preferred material to manufacture lever tab cover 459 is stainless steel sheet metal.

A lever adjustment screw 471 is threaded into a lever adjustment screw hole 453. The preferred material for lever adjustment screw 471 is stainless steel. A reasonable size is 8 mm by 25 mm.

Bail Block

Figure 4:
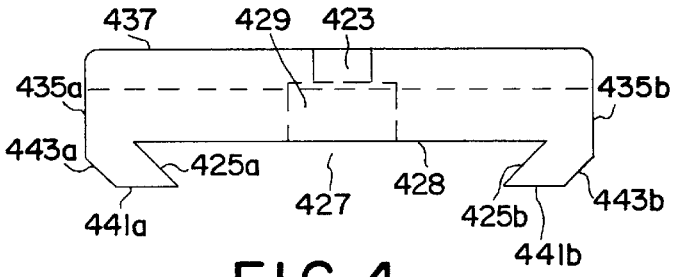
FIG. 4 shows an end view of a bail block.
Figure 6:
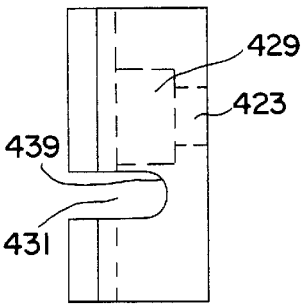
FIG. 6 shows a side view of a bail block.

A bail block 421*a,b* affixes to platform size adjustment region 215*a,b*. Bail block 421*a,b* has a bail block top surface 437, shown in FIGS. 4, 7 and 8, which contacts boot 601 when boot 601 is engaged in the binding. Bail block sides 435*a,b* and bail block ends 433*a,b* limit the extent of bail block 421*a,b*. A bail block platform cavity 427, FIG. 4, is approximately sized to mate with platform size adjustment region 215*a,b*. Bail block platform cavity 427 generally is formed by a bail block platform cavity edge 428 and a bail block angled edge 425*a,b*, FIG. 4. Bail block platform cavity 427 is slightly larger than a cross section of platform size adjustment region 215*a,b*, thereby avoiding an interference fit and allowing for bail block 421*a,b* to slide on platform 201. A bail block bail cavity 431*a,b*, shown in FIG. 6, has a trough like shape and retains rotary heel bail axle section 355*a,b*, FIG. 1, or toe bail first axle section 321*a,b*, FIG. 1. Bail block bail cavity 431*a,b*, FIG. 6, has a bail block bail cavity wall 439. A bail block base edge 441*a,b* is opposite bail block top surface 437. A bail block chamfer edge 443*a,b* connects bail block sides 435*a,b* to bail block base edge 441*a,b*. A bail block nut cavity 429 extends from bail block platform cavity edge 428 toward bail block top surface 437. Bail block nut cavity 429 is sized to accept size adjustment nut 151*a,b*. A bail block bore 423 provides a passage from bail block top surface 437 to bail block nut cavity 429.

It should be noted that the details of bail block platform cavity 427 are not limited to the embodiment disclosed. The important feature is that there exists a means to slideably affix bail block 421*a,b* to platform 201.

Additionally, bail block nut cavity 429 could be eliminated if bail block bore 423 was a through hole with internal threads sized to mate with size adjustment screw 501*a,b*. Materials to manufacture bail block 421*a,b* include, but are not limited to, aluminum, thermoplastics, reinforced thermoplastics, carbon fiber, Kevlar, and titanium.

Rotary Heel Bail

As shown in FIGS. 1 and 11 a rotary heel bail 351 has a rotary heel bail rounded section 353. Rotary heel bail rounded section 353 is joined to a rotary heel bail sloped section 357. Rotary heel bail sloped section 357 is joined to a rotary heel bail axle section 355*a,b*. Rotary heel bail axle section 355*a,b* is intentionally left out of alignment by a slight amount so that friction is generated when it is inserted into bail block bail cavity 431*b*. The friction normally prevents the bail from falling when a boot is inserted. Rotary heel bail axial section 355 has in its approximate center two rotary heel bail ends 359. Rotary heel bail ends 359 are separated by a rotary heel bail gap 361. Possible materials to manufacture rotary heel bail 351 include stainless steel, spring hardened stainless steel, titanium, and steel. The material of preference is stainless steel. If stainless steel is used in a non-hardened form, an optimum wire diameter range is approximately 5 mm to 8 mm. Such bails are considered wireforms and are made in four-slide machines.

Other Fasteners

Figure 9:
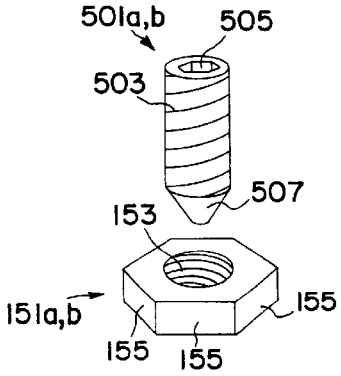
FIG. 9 shows an adjustment screw or fastener and nut.

As shown in FIGS. 1 and 9, a size adjustment screw 501*a,b* has a size adjustment screw thread 503. Size adjustment screw 501*a,b* has a size adjustment screw tool interface 505 and a size adjustment screw cone point 507. A size adjustment nut 151*a,b* has a size adjustment nut thread 153 sized to mate with nut 501*a,b*. Size adjustment nut 151*a,b* has six side adjustment nut flats 155. Four mounting screws 251*a,b,c,d* are sized to engage skiboard mounting holes 9*a*, 9*b*, 9*c*, 9*d*. Stainless steel is the preferred material for these fasteners.

Boot

As shown in FIG. 11, a boot 601 is comprised of a boot sole 615. Boot sole 615 is comprised of a boot heel sole 603 and a boot toe sole 605. Boot heel sole 603 has a boot heel lip 607 and a boot heel support zone 611. Boot toe sole 605 has a boot toe lip 609 and a boot toe support zone 613.

Overall Assembly

To assemble the binding, resilient material 101 is placed onto skiboard 3 so that resilient material screw holes 103*a*, 103*b*, 103*c*, 103*d* are aligned with skiboard mounting holes 9*a*, 9*b*, 9*c*, 9*d* as shown in Figure one. Then platform 201 is placed on top of resilient material 101. Mounting screws 251*a,b,c,d* are used to retain platform 201 and resilient material 101 to skiboard 3 by inserting them through platform screw holes 203*a*, 203*b*, 203*c*, 203*d* and resilient material screw holes 103*a*, 103*b*, 103*c*, 103*d* and securing them into skiboard mounting holes 9*a*, 9*b*, 9*c*, 9*d*. Size adjustment nut 151*a,b* is then placed into bail block nut cavity 429. Toe bail first axle section 321*a,b* and rotary heel bail axle section 355*a,b* are then each placed into a respective bail block bail cavity 431*a,b*. Bail blocks 421*a,b*, in conjunction with size adjustment nut 151*a,b*, toe bail 331, and rotary heel bail 351 are then slid onto platform size adjustment region 215*a,b*. Size adjustment screw 501*a,b* then placed through bail block bore 423 and threaded into size adjustment nut 151*a,b*.

Operation of Preferred Embodiment

Adjustment Mechanism Operation

Figure 7:
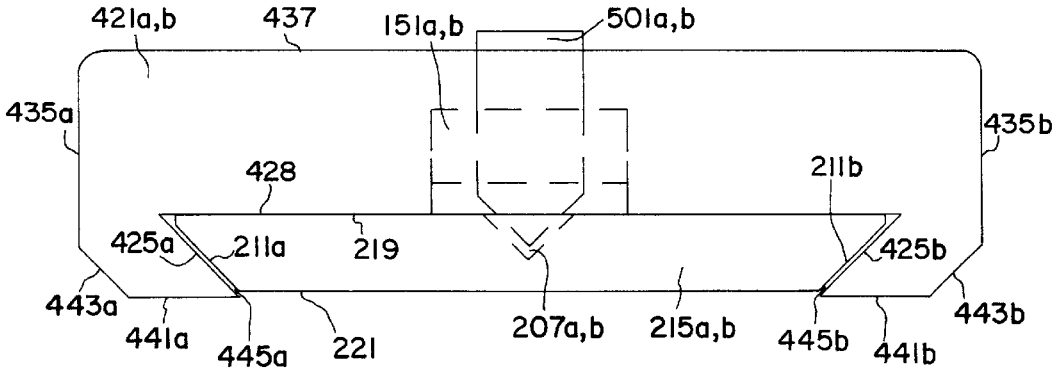
FIG. 7 shows an end view of a platform and bail block in an adjustment state.
Figure 8:
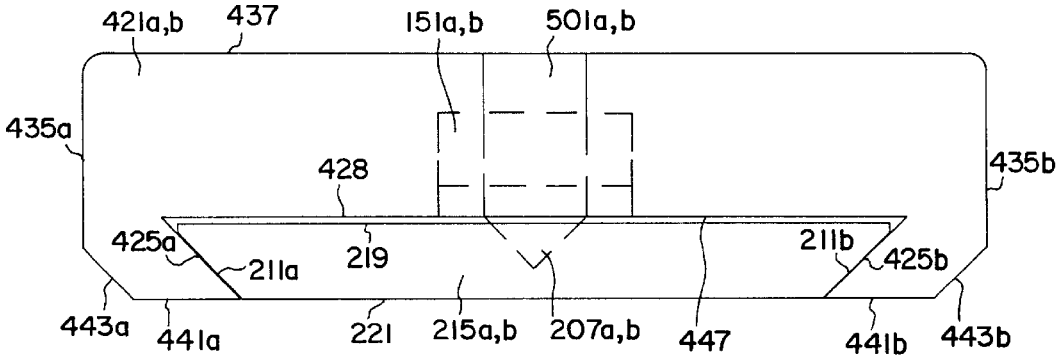
FIG. 8 shows an end view of a platform and bail block in a locked state.

FIGS. 7 and 8 show two states of the boot size adjustment mechanism. In FIG. 7 size adjustment screw 501*a,b* is raised slightly, so that an adjustment gap 445*a,b* can be formed and bail block 421*a,b* can slide on platform 201 for boot size adjustment. The ability for adjustment gap 445*a,b* to exist relies on the slightly oversize dimension of bail block platform cavity 427, FIG. 4, relative to platform 201. In FIG. 8 size adjustment screw 501*a,b* is lowered into an interference condition with platform size adjustment countersink 207*a,b*, thereby creating a locked state. In the locked state adjustment gap 445*a,b* vanishes since platform angled edges 211*a,b* are in contact with bail block angled edge 425*a,b*. Alternatively, in the locked state a lock down gap 447 is formed between bail block platform edge 428 and platform top surface 219. It is worthwhile to note that in the locked state bail block 421*a,b* and platform 201 are attached so that there is minimal possibility for relative motion there between in any direction. Specifically, there is little possibility for bail block 421*a,b* to slide on platform 201 in the longitudinal direction and there is little possibility for bail block 421*a,b* to rotate about the longitudinal axis of platform 201.

Binding Adjustment and Use

To adjust and use the binding, size adjustment screw 501*a,b* is first turned to a raised adjustment state, FIG. 7. Bail blocks 421*a,b* are then slid to a position that clamps the boot 601, FIG. 11. Then size adjustment screw 501*a,b* is then turned to a lowered locked state. In a locked state size adjustment screw cone point 507 has an interference fit with platform size adjustment countersink 207*a,b*, FIG. 8. Boot heel lip 607 is then placed in rotary heel bail rounded section 353. Lever scallop 463 and lever second rounded end 465 are then placed on boot toe lip 607, and, if adjusted properly to the boot size, lever 451 is pivoted past a dead center position toward boot 601. Lever adjustment screw 471 is then turned to ensure boot 601 is under sufficient tension. If the boot size adjustment were wrong, one would merely loosen size adjustment screw 501*a,b* and move the appropriate block-bail assembly to a new position, then re-tighten the size adjustment screw 501*a,b*. During this operation of boot size adjustment, note that no fasteners are removed from the binding. Rather, this design only requires loosening and tightening of fasteners. Due to this fact, neither toe bail 331 nor rotary heel bail 351 becomes separated from the binding during adjustment. Last, the user wears a boot 601 on each leg. Then, a skiboard and binding are attached to each boot, and the user can slide on snow for recreation, competition, or exercise.

Central Mount and Resilient Material

Platform 201 is centrally mounted to skiboard 3. Resilient material 101, being located between platform 201 and skiboard 3, in combination with the central mount enables the skiboard to flex with reduced influence of platform 201 and the binding in general. Additionally, resilient material 101 dampens unwanted vibration in skiboard 3 that would otherwise be transmitted to the user.

Description and Operation—Alternative Embodiments

Rectangular Platform and Rectangular Bail Block Embodiment

Figure 13:
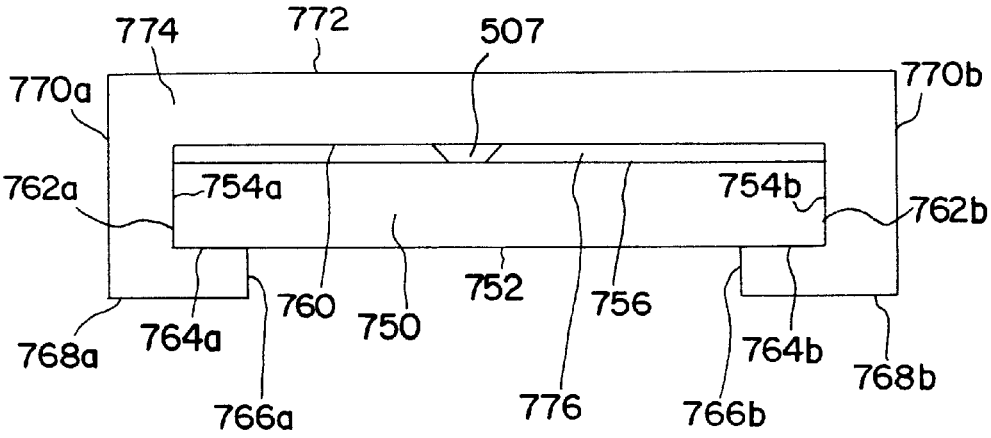
FIG. 13 shows a second embodiment of a platform end view and bail block in a locked state.
Figure 12:
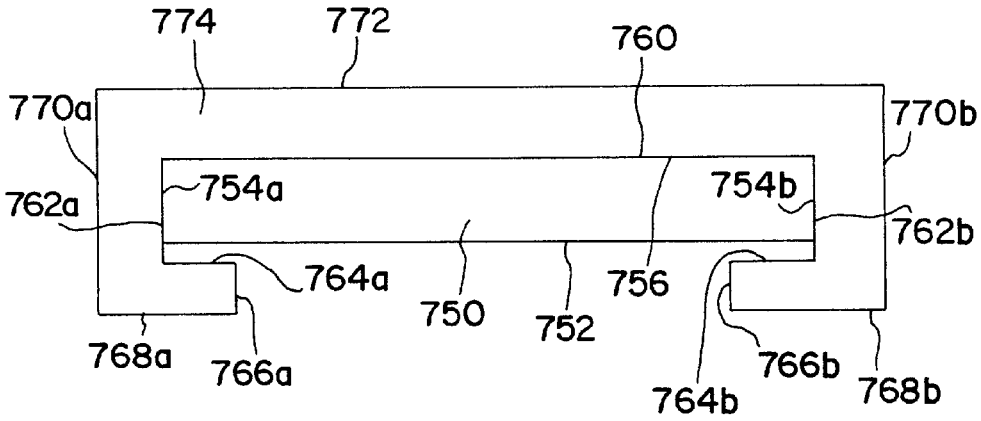
FIG. 12 shows a second embodiment of a platform end view and bail block in an adjustment state.

FIGS. 12 and 13 show a rectangular platform 750 having a rectangular platform bottom 752, rectangular platform edges 754*a,b*, and a rectangular platform top 756. A rectangular bail block 774 has a rectangular bail block top 772 generally in contact with boot 601. A rectangular bail block outer edge 770*a,b* limits the extent of rectangular bail block 774. A rectangular bail block bottom wall thickness 768*a,b* is opposite rectangular bail block top 772. Rectangular bail block recessed walls 766*a,b* approximately face each other. A rectangular bail block recessed bottom 764*a,b* opposes rectangular platform bottom 752. A rectangular bail block recessed edge 762*a,b* is adjacent to rectangular platform edges 754*a,b*. A rectangular bail block recessed inner 760 is opposite rectangular platform top 756. As shown in FIG. 13, rectangular platform 750 and rectangular bail block 774 are sized such that a rectangular lock down gap 776 exists when rectangular bail block 774 is in a locked state. The manufacture method and materials could be the same as mentioned for the preferred embodiment. This embodiment is intended to show that various structures are equivalents in terms of the functioning of the boot size adjustment mechanism. Specifically, a multitude of matching shapes could be used to perform the adjustment and lock down function.

Alternate Platform

Figure 14:
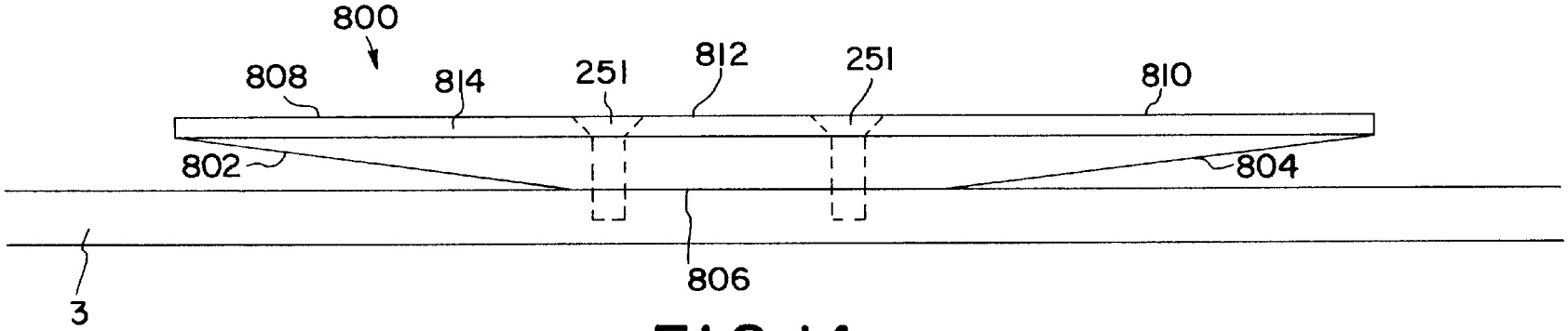
FIG. 14 shows a side view of a third embodiment platform.
Figure 15:
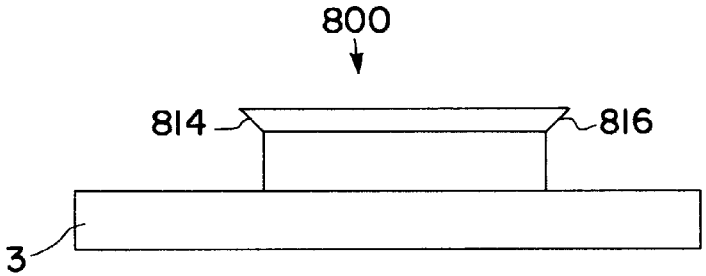
FIG. 15 shows an end view of a third embodiment platform.

FIGS. 14 and 15 show an alternate platform 800. Alternate platform 800 has an alternate platform first taper 802 and an alternate platform second taper 804. Alternate platform first taper 802 and alternate platform second taper 804 are generally not in contact with skiboard 3 when skiboard 3 is in a non-flexed rest state. An alternate platform contact zone 806 is adjacent to skiboard 3 and exists between alternate platform first taper 802 and alternate platform second taper 804. Alternate platform contact zone 806 could extend in the longitudinal direction of alternate platform 800 in the range of twenty to ninety percent of the total length of alternate platform 800. A typical extent would be twenty-five to fifty percent. An alternate platform first top zone 808 and an alternate platform second top zone 810 are separated by an alternate platform central top zone 812. Alternate platform central top zone 812 is approximately opposite alternate platform contact zone 806. Mounting screws 251 attach alternate platform 800 to skiboard 3 in alternate platform contact zone 806. An alternate platform first angled edge 814 and an alternate platform second angled edge 816 are shown in FIG. 15. Alternate platform first angled edge 814 and alternate platform second angled edge 816 are intended to perform the function of retaining bail block 421. This embodiment allows a lesser-inhibited flex of the skiboard under the platform and eliminates the resilient material. This embodiment offers modified performance and more than likely would require a molding or casting process to manufacture. Materials to manufacture alternate platform 800 include, but are not limited to, aluminum, thermoplastics, reinforced thermoplastics, carbon fiber, Kevlar, and titanium.

Mounting Plates

Figure 16:
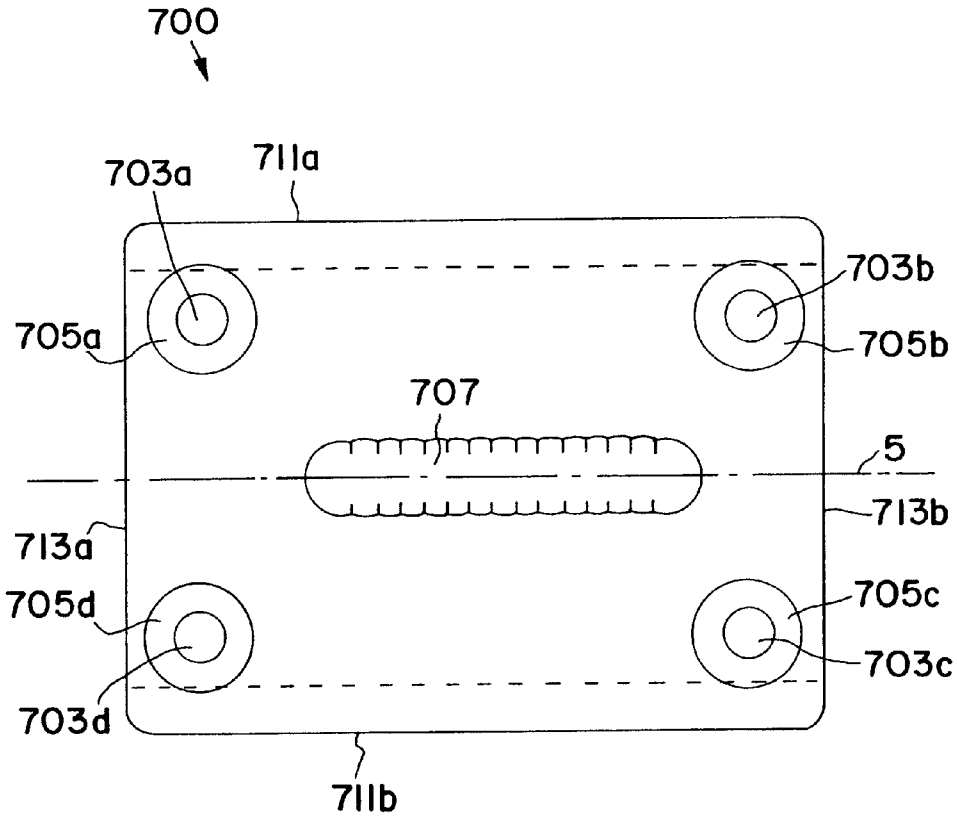
FIG. 16 shows a top view of a mounting plate.
Figure 17:
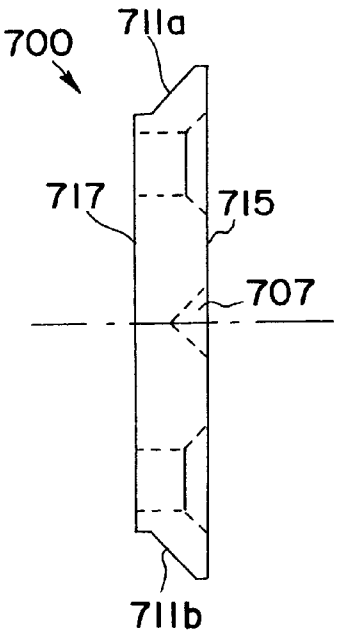
FIG. 17 shows an end view of a mounting plate.

FIGS. 16 and 17 show a mounting plate 700 having a mounting plate top surface 715 and a mounting plate bottom surface 717. The longitudinal extent of mounting plate 700 is limited by a mounting plate end 713*a,b*. The transverse extent of mounting plate 700 is limited by a mounting plate angled edge 711*a,b*. Mounting plate top surface 715 and a mounting plate bottom surface 717 share a mounting plate screw hole 703*a,b,c,d*. Mounting plate top surface 715 also has a mounting plate hole counter bore 705*a,b,c,d* and mounting plate adjustment counterbores 707. In this embodiment mounting plate 700 served the same function as platform 201 with the exception that mounting plate 700 interfaces with a single bail block 421, is shorter in longitudinal extent than platform 201, and mounts to skiboard 3 via mounting plate screw holes 703*a,b,c,d*. Hence, one binding would use two mounting plates 700. The manufacture of mounting plate 700 is analogous that of platform 201. This embodiment offers a means so that the binding can be mounted to a skiboard not designed for central mounting. Additionally, some users may prefer this embodiment.

CONCLUSION, RAMIFICATIONS, AND SCOPE OF INVENTION

Thus the reader will see that the binding invention is easy to use, has a low manufacture cost, offers high performance to the user, and is durable. The interlocking designs of the binding plate and boot support enable a simple, rigid, and durable adjustment mechanism. The preferred embodiment of the binding plate and boot support shows that can be manufactured by efficient means as already noted. The central mount of the binding plate and resilient material enhance the true flex of the skiboard as well as absorb vibration, providing the user with a high performance product.

While my above description contains many specificities, these should not be construed as limitations on the scope of the invention, but rather as exemplification of one preferred embodiment thereof. Many other variations are possible. For example the shape of the binding plate in FIG. 2 need not be a rectangle. It could widen in the is area of the central mount, and while more costly to manufacture, it would still function. Similarly, while the most cost-effective implementation of the adjustment means is done with a single fastener, a dual or multiple fastener implementation would also function. Additionally, the shape of size adjustment screw 501 was given as a cone point. While this fastener is readily available and sufficient, other shapes may also suffice, such as a half sphere. A half sphere pointed fastener would also require a spherical counterbore in platform 201. The alternate ramification shown in FIG. 12 and 13 gives another example of an embodiment. There is a multitude of detailed shapes that would interlock to serve the function. As another example, size adjustment nut 151*a,b* could be eliminated and replaced by threads tapped into bail block 421. While aluminum and stainless steel are given as the preferred the materials for construction, sufficient production volume may show that other materials such as thermoplastics are more cost effective. Another example is the reversal of lever 451 so that it grips the heel of the boot, rather than the toe. Another example is the elimination of one or more of the bails, their replacement being a step in mechanism.

Accordingly, the scope of the invention should be determined not by the embodiments illustrated, but by the appended claims and their legal equivalents.

LIST OF REFERENCE NUMERALS

3 Skiboard
5 Skiboard Longitudinal Axis
7 Skiboard Transverse Axis
9*a,b,c,d* Skiboard Mounting Holes
101 Resilient Material
103*a,b,c,d* Resilient Material Screw Holes
109*a,b* Resilient Material End
151*a,b* Size Adjustment Nut
153 Size Adjustment Nut Thread
155 Size Adjustment Nut Flats
201 Platform
203*a,b,c,d* Platform Screw Holes
205*a,b,c,d* Platform Screw Hole Counter Bore
207*a,b* Platform Size Adjustment Countersink
209 Platform Size Adjustment Countersink Edge
211*a,b* Platform Angled Edge
213*a,b* Platform End
215*a,b* Platform Size Adjustment Region
217 Platform Central Region
219 Plarform Top Surface
221 Platform Bottom Surface
223 Platform Edge Angle
251*a,b,c,d* Mounting Screws
331 Toe Bail
321*a,b* Toe Bail First Axle Section
323 Toe Bail Radius Section
325 Toe Bail Second Axle Section
327 Toe Bail Gap
351 Rotary Heel Bail
353 Rotary Heel Bail Rounded Section
355*a,b* Rotary Heel Bail Axle Section
357 Rotary Heel Bail Sloped Section
359 Rotary Heel Bail End
361 Rotary Heel Bail Gap
421*a,b* Bail Block
423 Bail Block Bore
425*a,b* Bail Block Angled Edge
427 Bail Block Platform Cavity
428 Bail Block Platform Cavity Edge
429 Bail Block Nut Cavity
431*a,b* Bail Block Bail Cavity
433*a,b* Bail Block Ends
435*a,b* Bail Block Sides
437 Bail Block Top Surface
439 Bail Block Bail Cavity Wall
441*a,b* Bail Block Base Edge
443*a,b* Bail Block Chain Edge
445*a,b* Adjustment Gap
447 Lock Down Gap
451 Lever
453 Lever Adjustment Screw Hole
455 Lever Finger Tab
457 Lever First Rounded End
459 Lever Tab Cover
460 Lever Tab Cover Hole

461 Lever Bail Slot
463 Lever Scallop
465 Lever Second Rounded End
471 Lever Adjustment Screw
473 Lever Cover Screw
475 Lever Tab Hole
501*a,b* Size Adjustment Screw
503 Size Adjustment Screw Thread
505 Size Adjustment Screw Tool Interface
507 Size Adjustment Screw Cone Point
601 Boot
603 Boot Heel Sole
605 Boot Toe Sole
607 Boot Heel Lip
609 Boot Toe Lip
611 Boot Heel Support Zone
613 Boot Toe Support Zone
615 Boot Sole
700 Mounting Plate
703*a,b,c,d* Mounting Plate Screw Holes
705*a,b,c,d* Mounting Plate Hole Counter Bore
707 Mounting Plate Adjustment Counterbores
711*a,b* Mounting Plate Angled Edge
713*a,b* Mounting Plate End
715 Mounting Plate Top Surface
717 Mounting Plate Top Surface
750 Rectangular Platform Cross Section
752 Rectangular Platform Cross Section Bottom
754*a,b* Rectangular Platform Cross Section Edge
756 Rectangular Platform Cross Section Top
760 Rectangular Bail Block Recessed Inner
762*a,b* Rectangular Bail Block Recessed Edge
764*a,b* Rectangular Bail Block Recessed Bottom
766*a,b* Rectangular Bail Block Recessed Wall
768*a,b* Rectangular Bail Block Bottom Wall Thickness
770*a,b* Rectangular Bail Block Outer Edge
772 Rectangular Bail Block Top
774 Rectangular Bail Block
776 Rectangular Lock Down Gap
777*a,b* Rectangular Adjustment Gap
800 Alternate Platform
802 Alternate Platform First Taper
804 Alternate Platform Second Taper
806 Alternate Platform Contact Zone
808 Alternate Platform First Top Zone
810 Alternate Platform Second Top Zone
812 Alternate Platform Central Top Zone
814 Alternate Platform First Angled Edge
816 Alternate Platform Second Angled Edge

What is claimed is:

1. A binding for attaching a boot to a ski comprising:

a rigid platform having a body extending along a longitudinal axis, the platform having multiple indents along its upper surface parallel to the longitudinal axis;

platform mounts for mounting the platform to the ski in a fixed longitudinal orientation;

first and second blocks, each having lower side arms adapted to extend about lateral side walls of the platform for interlocking with the side walls, such that the blocks and platform interlock in a vertical direction and are slidable relative to each other along the longitudinal axis;

block positioning means including a retractable feature extending into at least one of the indents for fixing the first and second blocks to the platform at respective positions along the longitudinal axis; and boot attachment means mounted to the first and second blocks respectively for receiving a boot.

2. The binding of claim 1 wherein the platform mounts are exclusively in an interior region of said body.

3. The binding of claim 1 wherein the ends of the rigid platform are tapered to allow for flexure in the ski.

4. The binding of claim 1 further comprising a cushion for mounting between the platform and the ski to allow for flexure in the ski.

5. The binding of claim 1 wherein an inner surface of the arms of the first and second blocks are tapered inwardly, and wherein the lateral side walls of the platform are tapered outwardly, such that the blocks and platform interlock in a vertical direction and are slideable along the longitudinal axis.

6. The binding of claim 1 wherein an inner surface of the arms of the first and second blocks extend vertically and include a horizontal lip for communicating with the lateral side walls of the platform, such that the blocks and platform interlock in a vertical direction and are slideable along the longitudinal axis.

7. The binding of claim 1 wherein the retractable feature is predominantly cylindrical in shape.

8. The binding of claim 1 wherein the retractable feature comprises a threaded fastener.

9. The binding of claim 1 wherein each of the first and second blocks include a hole, a nut recess, and a nut positioned in the recess in alignment with the hole, and wherein the retractable feature comprises a threaded fastener which, when tightened in the nut, urges the block arms against the platform body, to fix the block longitudinally with respect to the platform.

10. The binding of claim 9 wherein the multiple indents comprise indexed dimples at predetermined intervals and wherein the threaded fastener mates with the dimples to ensure an indexed positional relationship between the block and platform.

11. The binding of claim 9 wherein the threaded fastener, when tightened, is under compression between the block and the platform.

12. The binding of claim 1 wherein the platform mounts comprise a plurality of platform mount holes through the platform body and a plurality of platform mount screws passing through the holes for fixing the platform to the ski.

13. The binding of claim 1 wherein the retractable feature is comprised of at least one curved surface.

14. The binding of claim 13 wherein the retractable feature rotates during retraction.

15. The binding of claim 14 wherein the retractable feature also comprises at least one shaped protrusion for extending into at least one of the indents for fixing the first and second blocks to the platform at respective positions along the longitudinal axis.

16. A binding for attaching a boot to a ski comprising:

a rigid platform having a body extending along a longitudinal axis;

platform mounts for mounting the platform to the ski in a fixed longitudinal orientation;

first and second blocks, each having lower side arms adapted to extend about lateral side walls of the platform for interlocking with the side walls, such that the blocks and platform interlock in a vertical direction and are slidable relative to each other along the longitudinal axis;

block positioning means including a retractable feature for fixing the first and second blocks to the platform at respective positions along the longitudinal axis, wherein each respective retractable feature, when tightened, is under compression between the block and an upper surface of the platform body; and boot attachment means mounted to the first and second blocks respectively for receiving a boot.

17. The binding of claim 16 wherein the platform mounts are exclusively in an interior region of said body.

18. The binding of claim 16 wherein the platform includes multiple indents along its upper surface parallel to the longitudinal axis, and wherein the retractable feature extends into at least one of the indents.

19. The binding of claim 16 wherein the retractable feature comprises a threaded fastener.

20. The binding of claim 16 wherein the multiple indents comprise indexed dimples at predetermined intervals and wherein the retractable feature mates with the dimples to ensure an indexed positional relationship between the block and platform.

21. The binding of claim 16 wherein each of the first and second blocks include a hole, a nut recess, and a nut positioned in the recess in alignment with the hole, and wherein the retractable feature comprises a threaded fastener which, when tightened in the nut, urges the block arms against the platform body, to fix the block longitudinally with respect to the platform.

22. The binding of claim 16 wherein an inner surface of the arms of the first and second blocks are tapered inwardly, and wherein the lateral side walls of the platform are tapered outwardly, such that the blocks and platform interlock in a vertical direction and are slideable along the longitudinal axis.

23. The binding of claim 16 wherein an inner surface of the arms of the first and second blocks extend vertically and include a horizontal lip for communicating with the lateral side walls of the platform, such that the blocks and platform interlock in a vertical direction and are slideable along the longitudinal axis.

* * * * *